United States Patent [19]

Taylor

[11] Patent Number: 4,805,858

[45] Date of Patent: Feb. 21, 1989

[54] REFUSE BAG HOLDER

[76] Inventor: Blair T. Taylor, 30552 Mirandel La., Laguna Niguel, Calif. 92677

[21] Appl. No.: 135,646

[22] Filed: Dec. 21, 1987

[51] Int. Cl.[4] ..... B65B 67/12

[52] U.S. Cl. ..... 248/99; 24/130; 248/98

[58] Field of Search ..... 248/95, 99, 100, 97, 248/98; 24/129 B, 130

[56] References Cited

U.S. PATENT DOCUMENTS

| | | | |
|---|---|---|---|
| 886,241 | 4/1908 | Norton | 24/130 |
| 1,169,650 | 1/1916 | Kendall | 24/130 |
| 2,043,716 | 6/1936 | Sloan | 24/130 |
| 3,697,030 | 10/1972 | Schultz | 248/101 |
| 3,744,081 | 7/1973 | Miller | 248/101 X |
| 3,893,649 | 7/1975 | Cornell | 248/99 |
| 3,927,445 | 12/1975 | Pavlish | 248/95 X |
| 3,942,832 | 3/1976 | Haas | 294/55 |
| 3,953,911 | 5/1976 | Fishack | 24/130 X |
| 3,998,415 | 10/1976 | D'Antonio et al. | 248/101 |
| 4,124,185 | 11/1978 | Preisinger | 248/98 |
| 4,287,701 | 9/1981 | Washington | 248/99 X |
| 4,318,521 | 3/1982 | Martin et al. | 248/99 |
| 4,338,979 | 7/1982 | Dow | 248/101 X |
| 4,550,440 | 10/1985 | Rico | 248/99 X |

FOREIGN PATENT DOCUMENTS 554881 7/1943 United Kingdom ..... 248/95

*Primary Examiner*—Alvin C. Chin-Shue
*Assistant Examiner*—David L. Talbott
*Attorney, Agent, or Firm*—Charles E. Cates

[57] ABSTRACT

A device for holding refuse bags in an open position to receive refuse, which device can be made from a single length of rigid material shaped to form a frame surrounding an open area. The frame is provided with a channel running substantially about its periphery and positioned on the outer side of the frame. In forming the frame, the outer side of one end of the frame is positioned adjacent to an inner side of the frame in such a manner that a space is formed between the outer side of the frame end and the inner side of the frame. One end of a length of cord is fastened to the frame. In use, a bag is placed in the open area surrounded by the frame and the open end of the bag is folded over the frame. The cord is then extended about the frame and in the channel to secure the bag to the frame. Thereafter, the free end of the cord is passed between the adjacent sides of the frame and locked in the space.

7 Claims, 2 Drawing Sheets

REFUSE BAG HOLDER

FIELD OF THE INVENTION

This invention relates to devices for holding and supporting refuse bags or sacks in an open position so that refuse, leaves, grass clippings and the like may be easily put into the bag. More particularly, this invention relates to a refuse bag holder that can be used in a variety of ways to facilitate the collection of refuse in the bag. For example, in one embodiment the bag holder and the refuse bag can be positioned at ground level so that leaves or grass clippings can be easily directed into the refuse bag by rake, broom and the like. In another embodiment, the bag holder can be mounted to a wheeled cart wherein the refuse bag can be transported about in a substantially vertical position and refuse placed into the bag from above the bag opening. Additionally, the bag holder can be mounted in a more or less permanent manner to a wall or to a post in public areas and provide a convenient point for the disposal of refuse.

DESCRIPTION OF PRIOR ART

There are numerous devices in use in commerce as well as disclosed in the literature for holding refuse bags in an open position. One such device consists of a metal hoop which is provided with a generally U-shaped channel. The mouth of the bag is brought up through the hoop and folded over the hoop and an elastic cord is placed around the hoop and in the U-shaped channel to secure the bag to the hoop. The hoop can then be mounted on a wheeled cart, post and the like. U.S. Pat. Nos. 3,893,649; 3,942,839 and 4,287,701 generally disclose bag stiffening devices having generally C-shaped cross sectional configurations for receiving corresponding bands or the like for engaging the bag mouths and hold the bag in an open position. Additionally, U.S. Pat. Nos. 4,318,521; 3,998,415 and 3,697,030 disclose refuse bag holding devices which include integral spikes or stakes as ground anchoring means.

SUMMARY OF THE INVENTION

This invention provides a device for holding bags or sacks in an open position to receive refuse, leaves, grass clippings and the like. The device is easy to make, relatively inexpensive, and readily adaptable for installation in a variety of ways as the situation may require. The bag holding device can be made from a single length of rigid material which is bent in a variety of shapes to form a frame which surrounds an open area. The open area will readily receive an open bag and the perimeter of the open end of the bag is then folded over the frame a distance. The frame is provided with a channel or groove which runs substantially about the periphery of the frame and which is positioned on the outer side of the frame. In forming the frame, which can be made from a single piece of rigid stock, the outer side of one end of the frame is positioned adjacent to or overlaps an inner side of the frame in a manner such that a space or groove is formed between the outer side of the frame end and the inner side of the frame. Additionally, one end of a length of cord is fastened to the frame and in use, the free end of the cord is extended and passed about the frame in the channel or groove to engage the open end of the bag against the frame to retain the open bag to the frame. Subsequently, the free end of the cord is then passed between the adjacent sides of the frame and in the space. The dimensions of the space are such that the free end of the cord will be snugly engaged in the space so as to exert a constant tension on the cord against the sides of the frame and of course the open end of the bag to retain the open bag within the frame.

In one embodiment, the device is provided with a spike like member which can be an extension of the frame enabling the bag holder to be anchored in the ground so that the opening of the bag is at ground level and the trash or refuse may be easily raked into the opened bag. In another embodiment the device is mounted to a wheeled cart so that the open bag mounted on the frame can be transported about in a vertical position and refuse placed into the bag from above the bag opening. In a still further embodiment, the device is mounted on a wall, post and the like.

BRIEF DESCRIPTION OF THE DRAWINGS

FIG. 1 is a perspective view of a bag holder with a trash bag mounted on the holder and mounted at ground level for receiving leaves and the like;

DESCRIPTION OF PREFERRED EMBODIMENTS

Figure 2:
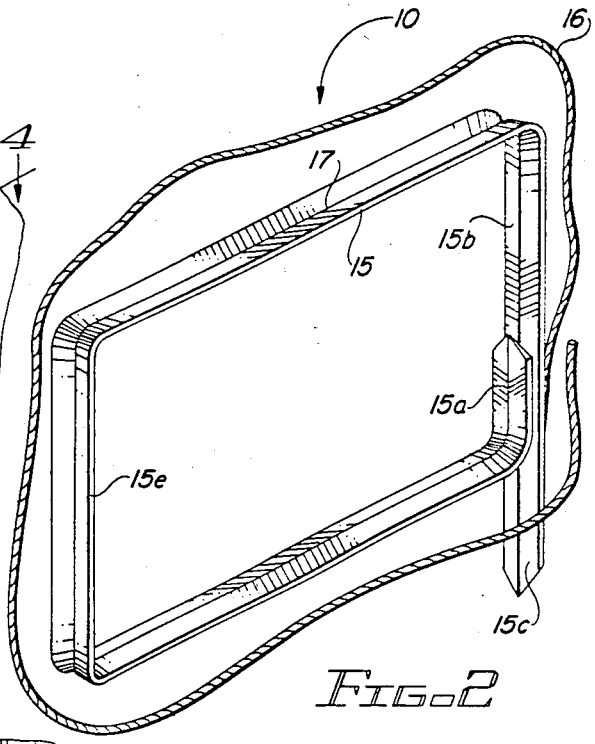
FIG. 2 is a perspective view of the bag holder.
Figure 3:
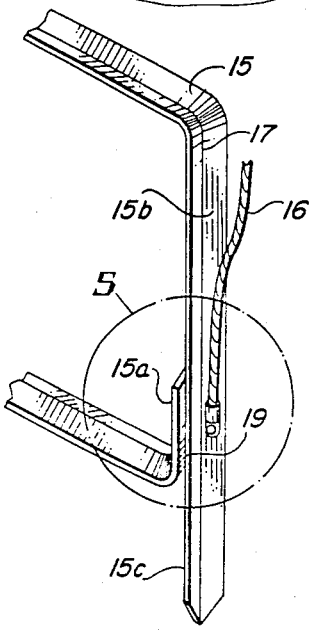
FIG. 3 is a perspective view of a portion of the bag holder shown in FIG. 2.
Figure 5:
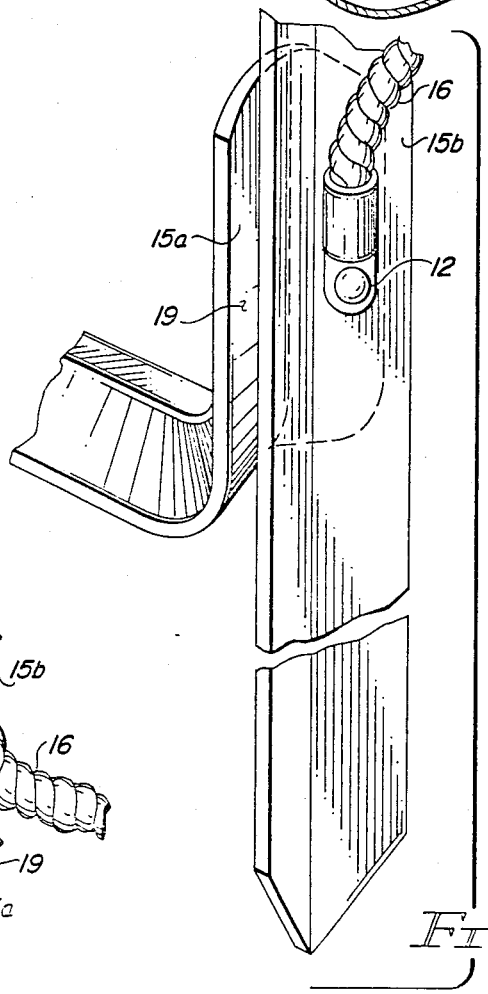
FIG. 5 is an enlarged perspective view of the area designated "5" of FIG. 3.

Referring to the drawings, in FIG. 2 the numeral 10 denotes generally a bag holding device having a frame 15 formed of a rigid material and provided with a cord 16 secured to the frame by means of rivet 12 and which cord is of a length such that it will extend around the frame. As shown, frame 15 is generally rectangular in shape although the shape may take a variety of geometrical forms, for example, a triangle, circle or semi-circle, just so long as the frame encloses or surrounds an appropriate area into which a refuse bag may be placed. Additionally one side **15*b* of frame 15 is extended to serve as a stake 15*c* so as to enable the frame to be anchored in the ground. Stake 15*c* is of an appropriate length so that when pushed into the ground it will support bag holding device 10** in a substantially vertical position.

Frame 15 is preferably formed from a single length of rigid stock such as aluminum, steel, plastic and the like. The frame is provided with channel 17 about its periphery and positioned on the outer side of the frame. In the various embodiments shown in the drawings the channel is V-shaped. However, the channel may be a variety of shapes such as U-shaped or C-shaped, the channel being such that it can receive the cord 16.

Figure 1:
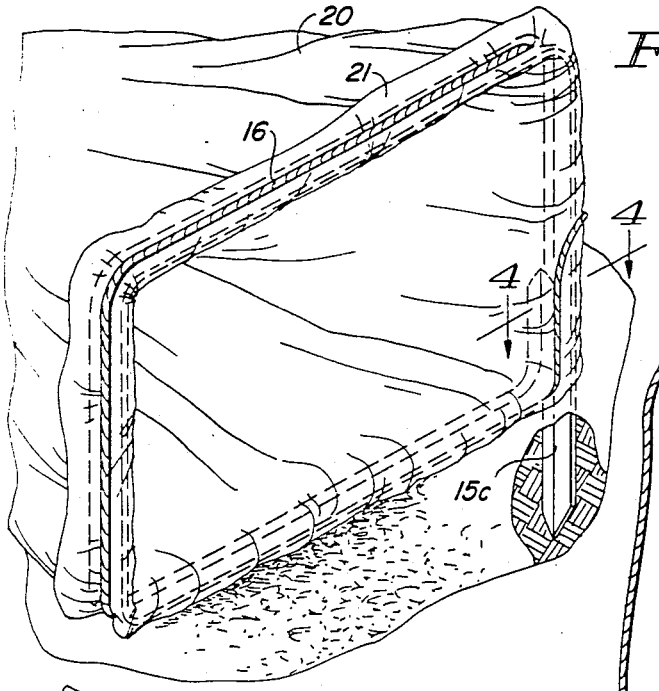

As shown generally in FIGS. 1 and 2 and in greater detail in FIGS. 3–6, in one embodiment end 15*a* of frame 15 is positioned adjacent to or overlaps side 15*b* of frame 15 in such a manner that a space or groove 19 is formed between the inner side of the V-shaped channel 17 and the outer side of said frame end and the inner side of frame member 15*b*. More specifically, it will be seen that frame end 15*a* is not in the same plane or the same alignment as frame side 15*b* as well as substantially all of frame 15. End 15*a* has been bent away from the plane somewhat so that only a portion of the outer side of end 15*a* makes contact with a portion of the inner side of frame member 15*b*. This non-alignment and the resulting groove 19 is shown best in FIGS. 4 and 5 where a portion of the outer side of frame end 15*a* is secured to a portion of the inner side of frame member 15*b* by means of rivet 12, which also secures cord 16 to the frame. By positioning frame end 15*a* adjacent to and overlapping frame member 15*b* in the foregoing manner, the free end of cord 16 can be engaged in groove 19 in a snug manner. Thus the width of groove 19 is somewhat less than the diameter of cord 16 to help lock the cord in the groove.

Figure 6:
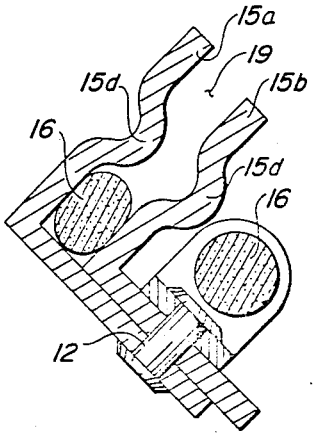
FIG. 6 is a sectional view similar to that of FIG. 4 showing a somewhat modified frame member.
Figure 4:
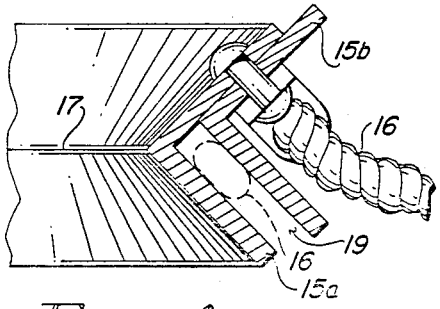
FIG. 4 is a sectional view taken on the line 4—4 of FIG. 1.

A slightly different means for securing cord 16 in groove 19 is shown in section in FIG. 6 where one side wall of frame 15 is provided with a rounded protrusion 15*d* which can be formed throughout the entire length of the frame. Protrusion 15*d* makes it less likely that cord 16 will be accidentally released from groove 19.

Figure 11:
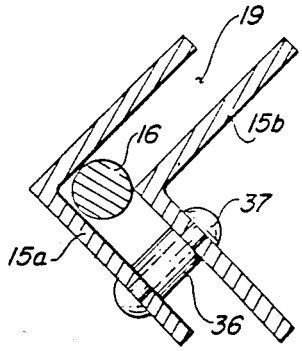
FIGS. 11 and 12 are sectional views showing alternatives for positioning the frame end adjacent to a frame side.
Figure 12:
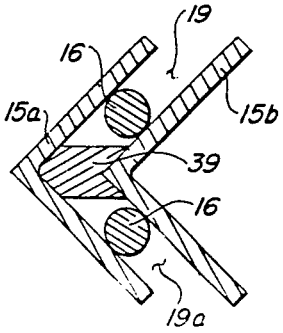

Shown in section in FIGS. 11 and 12 are alternatives for positioning frame end 15*a* adjacent to frame side 15*b* of frame 15. It is seen that frame end 15*a* and frame side 15*b* are in substantially the same plane. As shown in FIG. 11, a hollow bushing 36 is placed between end 15*a* and side 15*b*. Rivet 37 passes through opposed sides of said frame end and frame side and bushing 36 to rigidly align the frame end and frame side and form the appropriate groove or space 19. In FIG. 12, frame end 15*a* and frame side 15*b* are positioned adjacent one another and in the same plane. A spacer 39 is centered between said end and side and is secured to said end and side by means of spot welding or high strength resin adhesive. In this embodiment two grooves 19 and 19(*a*) are formed and either can receive the free end of cord 16.

Referring to FIG. 1 it will be seen that bag holding device 10 is used in conjunction with bag 20 which may be of any suitable, flexible material, such as polyethylene, polypropylene and the like. The open end 21 or mouth of bag 20 has been inserted through the open area surrounded by frame 15 and then the perimeter 21 of the open end of the bag has been folded over the frame a distance. Cord 16 has been extended about frame 15 and in channel 17 to engage the perimeter of the open end of the bag to the frame and then secured in groove 19. Bag holding device 10 and the attached bag 20 are anchored in the ground by means of stake 15*c* so that refuse may be easily raked into the open bag.

Figure 7:
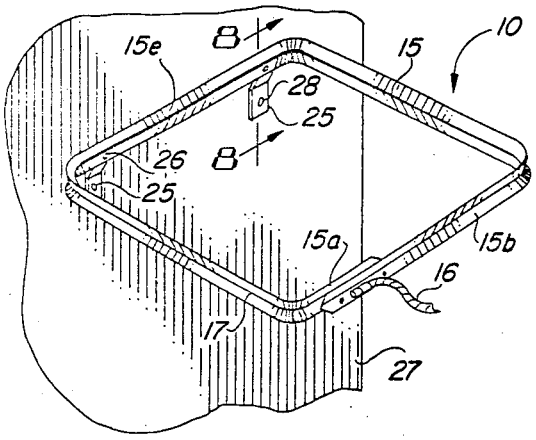
FIG. 7 is a perspective view of another embodiment of the bag holder.
Figure 8:
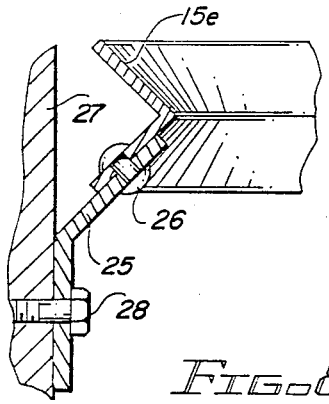
FIG. 8 is a sectional view taken on line 8—8 of FIG. 7.

The versatility of bag holding device 10 is further demonstrated in the additional embodiments shown in FIGS. 7–10. In these embodiments the bag holding device has been adapted for mounting to a wheeled cart, wall or post and of course for such embodiments, stake 15*c* is no longer required. FIGS. 7 and 8 show the bag holding device modified for mounting to a wall. Frame 15 is of the same construction as previously described except for the lack of a stake. As shown, a pair of angled supports 25 have been secured to frame side member 15*e* by means of rivets 26 and then the frame and supports are fastened to wall 27 by suitable wall fastening means 28. In usage, as with the embodiments shown in FIGS. 1–6 and 11–12, the open end or mouth of a refuse bag is inserted through the open area surrounded by frame 15 and then the perimeter of the open end of the bag is folded over the frame a distance. Cord 16 is then extended about frame 15 and channel 17 engaging the perimeter of the open end of the bag to the frame and ultimately secured in groove 19.

Figure 9:
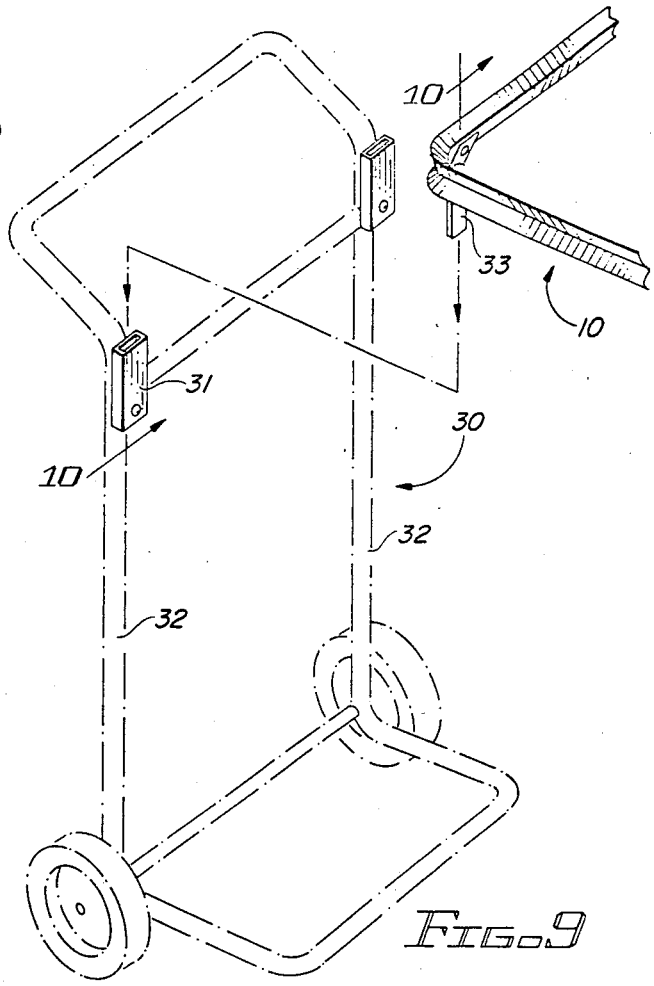
FIG. 9 is a perspective view showing an additional means of mounting the bag holder.
Figure 10:
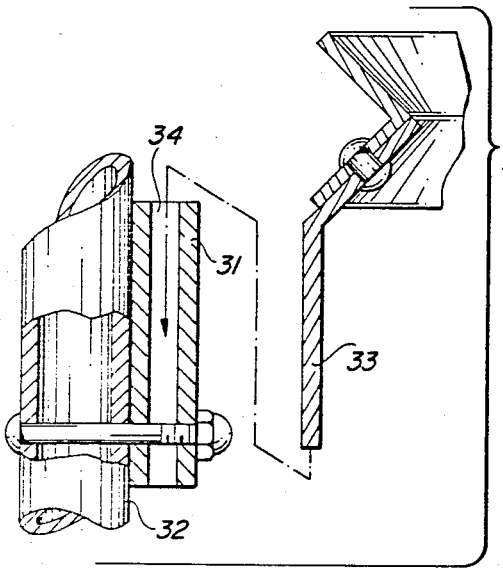
FIG. 10 is a sectional view taken on the line 10—10 of FIG. 9.

FIGS. 9 and 10 show a bag holding device mounted to a two-wheeled cart shown generally at 30 which enables the refuse bag to be transported about in a substantially vertical position and refuse placed in the bag from above the bag opening. Mounted at the upper end of vertical members 32 of cart 30 is a pair of support receiving members 31. A pair of support members 33 have been attached to one side of frame 15 and depend vertically from the frame. Each of the support receiving members 31 is provided with slot-like opening 34 which is appropriately sized to receive supports 33. The supports 33 are inserted into support receiving members 31 thereby firmly securing the bag receiving device to cart 30.

While the invention has been described and illustrated in several preferred embodiments, it should be understood that the invention is not to be limited to the precise details herein illustrated and described since the same may be carried out in other ways falling within the scope of the invention as illustrated, described and claimed.

I claim:

1. A device for supporting a bag and holding such bag in an open position comprising in combination:

(a) a rigid frame surrounding an open area which area can receive an opened bag folded over said frame a distance;

(b) said frame having inner and outer sides with a channel substantially about the periphery of said frame and positioned on the outer side thereof;

(c) a cord member with an end thereof secured to said frame;

(d) the outer side of one end of said frame positioned adjacent and overlapping an inner side of said frame in a manner such that a space is formed between the outer side of said frame end and of the inner side of said frame;

(e) whereby the free end of said cord member is extended and passed about said frame in said channel to engage said bag against said frame and thereafter between adjacent sides of said frame in said space, the dimensions of said space being such that the free end of said cord member is snugly engaged in said space so as to exert a tension on said cord and against the side of said frame.

2. The device of claim 1 wherein said frame end and said frame side are not in the same plane.

3. The device of claim 2 wherein a portion of the outer side of said frame end is in contact with a portion of the inner side of said frame side resulting in a space formed between the non-contacting portions of said frame end and frame side.

4. The device of claim 3 wherein said channel is V-shaped and wherein the contacting portions of said frame end and frame side are held together by fastening means.

5. The device of claim 3 wherein a side wall of said frame is provided with a protrusion which extends into said space to aid in securing said cord in said space.

6. The device of claim 1 wherein one end of said frame is extended to form a stake whereby said device may be anchored in the ground.

7. The device of claim 1 wherein said frame end and said frame side are substantially in the same plane with means positioned between said frame end and frame side whereby two spaces are formed, either of which can receive the free end of said cord member.

* * * * *